US005230223A

United States Patent [19]

Hullar et al.

[11] Patent Number: 5,230,223

[45] Date of Patent: Jul. 27, 1993

[54] METHOD AND APPARATUS FOR EFFICIENTLY CONTROLLING REFRIGERATION AND AIR CONDITIONING SYSTEMS

[75] Inventors: Gordon C. Hullar, Cincinnati, Ohio; Jerry F. Justice, Ft. Thomas, Ky.

[73] Assignee: EnviroSystems Corporation, Cincinnati, Ohio

[21] Appl. No.: 855,614

[22] Filed: Mar. 20, 1992

[51] Int. Cl.[5] ..... F25B 41/00

[52] U.S. Cl. ..... 62/196.4; 62/126

[58] Field of Search ..... 62/126, 129, 216, 196.4, 62/DIG. 17

[56] References Cited

U.S. PATENT DOCUMENTS

| | | | |
|---|---|---|---|
| 2,483,102 | 9/1949 | Pierson | 346/32 |
| 2,621,487 | 12/1952 | Warren | 62/205 |
| 2,649,013 | 8/1953 | Schnelle | 88/14 |
| 2,869,330 | 1/1959 | Kramer | 62/196.4 X |
| 3,090,222 | 5/1963 | Akaboshi et al. | 73/53 |
| 3,412,570 | 11/1968 | Pruett, Sr. | 62/129 |
| 3,449,051 | 6/1969 | Levitt | 356/130 |
| 3,450,476 | 6/1969 | Rando | 356/107 |
| 3,797,940 | 3/1974 | King | 356/134 |
| 4,136,528 | 1/1979 | Vogel et al. | 62/196.4 X |
| 4,167,858 | 9/1979 | Kojima et al. | 62/126 |
| 4,284,352 | 8/1981 | Carson et al. | 356/134 |
| 4,286,873 | 9/1981 | Carson | 356/130 |
| 4,328,682 | 5/1982 | Vana | 62/129 X |
| 4,381,895 | 5/1983 | Hughes et al. | 356/134 |
| 4,535,603 | 8/1985 | Willitts et al. | 62/196.4 |
| 4,586,828 | 5/1986 | Winter et al. | 62/126 X |
| 4,644,755 | 2/1987 | Esslinger et al. | 62/126 |
| 4,710,643 | 12/1987 | Schmukler et al. | 250/573 |
| 4,882,928 | 11/1989 | Lane, Jr. et al. | 73/19 |
| 4,902,202 | 2/1990 | Bowden | 417/310 |
| 5,072,595 | 12/1991 | Barbier | 62/129 |

*Primary Examiner*—Harry B. Tanner
*Attorney, Agent, or Firm*—Frost & Jacobs

[57] ABSTRACT

A refrigeration control system is disclosed for operating a refrigeration system in a very efficient manner by controlling the refrigerant pressure in the refrigerant line between the liquid receiver and the evaporator at a pressure which is just above that at which bubbles ("flashgas") occur. An electronic sight glass is used to detect such flashgas bubbles in that liquid refrigerant line thereby indicating that more cooling capacity is required to properly operate the refrigeration system. The system controller can efficiently control various refrigeration components such that the electrical power drawn by the compressor motor is at an optimal or near-optimal rate of consumption at any given cooling requirement within the refrigeration system's cooling capacity. Some of the devices that can be controlled by the system controller include condenser fans, pressure control valves, reciprocating compressors, and screw compressors.

7 Claims, 5 Drawing Sheets

METHOD AND APPARATUS FOR EFFICIENTLY CONTROLLING REFRIGERATION AND AIR CONDITIONING SYSTEMS

TECHNICAL FIELD

The present invention relates generally to refrigeration and air conditioning system control equipment and is particularly directed to making the most efficient use of compressors which consume the majority of electrical energy in refrigeration systems. The invention will be specifically disclosed in connection with the use of an electronic sight glass to detect bubbles in the liquid refrigerant line, either by controlling the compressor to increase the liquid refrigerant pressure, or by controlling other equipment to more efficiently use the cooling capacity of the refrigeration system.

BACKGROUND OF THE INVENTION

Refrigeration systems have been used for many years of the type which use a compressor to drive a refrigerant through a closed-loop system. The compressor increases both the pressure and the temperature of the vaporous refrigerant before the refrigerant is directed into a condenser. As it passes through the condenser, the vaporous refrigerant is cooled and condensed to a liquid, while releasing heat to the surrounding environment, usually with the aid of a fan. The liquid refrigerant is now directed to a thermal expansion valve which provides a controlled release of the high pressure liquid refrigerant into a series of coils, commonly called an evaporator. As it passes through the thermal expansion valve, the liquid refrigerant undergoes a change of state from a high pressure liquid to a lower pressure vapor, while extracting thermal energy from the atmosphere surrounding the evaporator. The vaporous refrigerant is then drawn into the compressor to close the loop and to restart the process cycle.

When the outside air temperature falls below a certain temperature, many existing refrigeration systems cannot operate at a low enough condensing capacity without generating a condition known as liquid "hold-up" in the condenser. Liquid hold-up occurs when liquid refrigerant is backed up from the liquid receiver into the condenser, thus flooding a portion of the condenser with such liquid, thereby reducing the capacity of the condenser to transfer heat from the refrigeration system. This is very inefficient from an energy utilization standpoint, because unnecessary fans are running, excessive pressure drop occurs in the liquid line between the condenser and liquid receiver, and the compressor is working harder than necessary when this condition exists.

The compressor is typically driven by an electric motor and the major portion of system energy usage is incurred by the compressor's operation. It is important to keep the pressure at the outlet of the compressor sufficiently high to force the liquid refrigerant to remain in a liquid state in the refrigerant line between the condenser and the evaporator. If the outlet pressure is not sufficiently high at the compressor, then vaporous bubbles (called "flashgas") will form in the refrigerant line, thus reducing the overall system efficiency and cooling capacity since the thermal expansion valve (TEV) capacity is reduced when the refrigerant coming to it is in a partially vaporous state. The flashgas bubbles can be detected directly by an optical sensor, such as that disclosed in U.S. Pat. No. 4,644,755, by Esslinger et al.

In present refrigeration systems, the compressor outlet pressure is typically raised to the very high level sufficient to effectively cool the associated air spaces on the hottest day expected for that cooling season. This method of operation is, of course, not very efficient from an energy usage standpoint, since the compressor is continually consuming electrical energy at a rate that is calculated to properly work on the hottest day of that cooling season. On days where the outside ambient temperature is not as hot as the design temperature, such a refrigeration system is wasting a great amount of electrical energy.

A refrigeration system that has the capability to control the pressure in liquid refrigerant lines just above that required to maintain refrigerant in a liquid state could save electrical energy. The amount of energy saved would be the difference in the electrical energy utilized to drive the compressor hard enough to effectively cool the associated air spaces on the hottest day expected for that cooling season, and the electrical energy utilized to drive the compressor such that the pressure in the liquid refrigerant lines is controlled to a near optimal value. This energy saving would be significant, perhaps as much as fifteen percent (15%) of the entire electrical energy consumed by the refrigeration system.

A refrigeration control system that could perform the above energy savings and yet be retrofitted into existing refrigeration systems could save countless energy dollars without incurring the expense of installing entirely new refrigeration systems. If such a control system would be easily installed, then the expense of retrofitting the new refrigeration control system could be paid for quickly as the savings in energy usage occurs once the new system was put into operation.

SUMMARY OF THE INVENTION

Accordingly, it is a primary object of the present invention to provide a refrigeration control system which can detect the state of the refrigerant flowing between the liquid receiver and the evaporator, and use that information to control the refrigerant pressure at the outlet of the compressor so as to operate the system at an optimal or nearoptimal energy usage rate.

It is another object of the present invention to provide a refrigeration control system which can increase its effective system cooling capacity by eliminating flashgas bubbles at the thermal expansion valve while controlling the refrigerant pressure at the outlet of the compressor so as to operate the system at an optimal or near-optimal energy usage rate.

Yet another object of the present invention is to provide a refrigeration control system which can increase its effective system cooling capacity by controlling physical devices (such as condenser fans, pressure control valves, screw compressors, and the like) in the refrigeration system so as to eliminate flashgas bubbles at the thermal expansion valve while operating the refrigeration system at an optimal or near-optimal energy usage rate.

It is a further object of the present invention to provide a refrigeration control system that reduces the amount of refrigerant material required to properly charge a refrigeration system by reducing the hold-up of liquid refrigerant in the system.

It is yet another object of the present invention to provide a control system which increases the energy usage efficiency of a refrigeration system by reducing refrigerant pressure at the compressor outlet and turning off unneeded condenser fans, while maintaining the refrigerant at the thermal expansion valve in a liquid state.

It is a yet further object of the present invention to provide a refrigeration control system that includes a sensor to detect when liquid droplets exist in the vaporous refrigerant line which leads to the inlet of the compressor, thereby enabling an alarm which can shut the refrigeration system down before the compressor is damaged by such liquid droplets, if corrective action is not taken quickly enough.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved refrigeration control system is provided which senses the state of refrigerant in the refrigerant line between the liquid receiver and the evaporator, and controls the refrigerant pressure at the compressor outlet so as to prevent flashgas bubbles from occurring in the refrigerant line between the liquid receiver and the evaporator. An electronic sight glass, which can be installed in both new and existing refrigeration systems, is used to detect whether or not any flashgas bubbles exist in the liquid refrigerant line. The electronic sight glass is a sensing device which has an electrical signal output that is connected to a system controller which controls various devices in the refrigeration system in such a manner to prevent flashgas bubbles from occurring in the refrigerant line between the liquid receiver and the evaporator. The system controller uses the signal output from the electronic sight glass sensor to control the refrigerant pressure at the outlet of the compressor, thereby operating the system at an optimal or near-optimal energy usage rate.

In one preferred method of control, the system controller can be used to turn condenser fans on or off, or to vary the speed of one of the condenser fans. By controlling the condenser fans, the refrigerant pressure can be controlled in the liquid refrigerant line between the liquid receiver and the evaporator to a pressure just above that required to keep the refrigerant in a liquid state, thereby preventing the formation of flashgas for any appreciable length of time. The electronic sight glass can be used as the only sensor in the present invention to control the refrigeration system as described above, or an outside air temperature sensor can be added to the system to provide more information to the system controller as the controller determines when and which fan(s) to turn on or off, or as it controls the speed of a variable speed fan.

In another preferred method of control, the subject system controller can be used to control a pressure control valve (PCV) located in hot gas bypass line that runs between the condenser inlet and the condenser outlet so as to warm the liquid refrigerant in the line between the liquid receiver and the evaporator. This warming of the liquid refrigerant tends to reduce the liquid hold-up effect at the condenser when the refrigeration system might otherwise be excessively cooling the refrigerant as it leaves the condenser (which usually occurs when the outside air temperature falls below a certain threshold temperature). The system controller can warm the liquid refrigerant to a temperature which is just below the temperature at which flashgas bubbles would occur by allowing a controlled amount of hot refrigerant gas to enter the liquid refrigerant line.

In a further preferred method of control, the system controller can be used to control a pressure control valve that is located at the inlet to the liquid receiver. This pressure control valve can directly control the refrigerant pressure in the line between the liquid receiver and the evaporator whereby such pressure will be maintained just above the pressure at which flashgas bubbles would occur.

In yet another preferred method of control, the subject system controller can be used to raise or lower the speed at which a screw compressor operates, thereby directly controlling the refrigerant pressure at the compressor outlet. As the compressor outlet pressure is increased, the liquid refrigerant pressure in the line between the liquid receiver and the evaporator will also increase, which will tend to reduce or eliminate any flashgas bubbles in that part of the refrigerant line. As the compressor outlet pressure is decreased, the liquid refrigerant pressure in the line between the liquid receiver and the evaporator will also decrease, which will tend to increase the possibility of flashgas bubbles occurring in that liquid refrigerant line. The system controller will control the screw compressor's speed to just above that speed required to ensure refrigerant is in a liquid state, thus enabling the refrigeration system to operate at very close to optimal efficiency.

In another version of a refrigeration system made in accordance herewith, an electronic sight glass sensor is placed in the low pressure vaporous refrigerant line between the evaporator and the inlet to the compressor. In such arrangement, the electronic sight glass sensor can detect whether or not any liquid droplets exist in that refrigerant line, and if so, can generate an alarm at the system controller so that corrective action is taken or the refrigeration system can be shut down before the compressor is damaged.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and forming a part of the specification illustrates several aspects of the present invention, and together with the description serves to explain the principles of the invention. In the drawing.

DETAILED DESCRIPTION OF THE PREFERRED EMBODIMENT

Reference will now be made in detail to the present preferred embodiments of the invention, examples of which is illustrated in the accompanying drawing, wherein like numerals indicate the same elements throughout the views.

Figure 1:
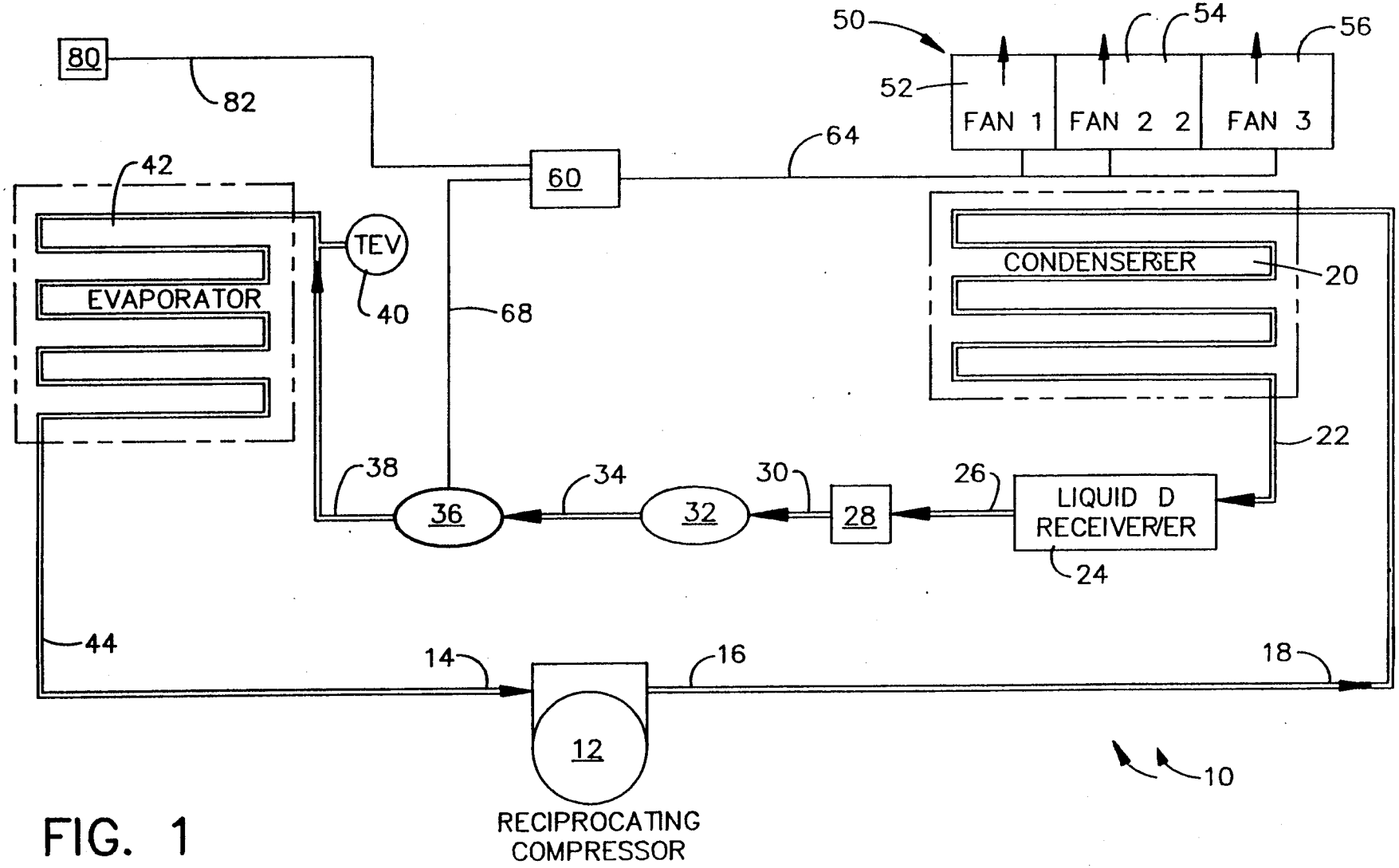
FIG. 1 is a diagrammatic view of a refrigeration system having a system controller of the present invention which receives information from an electronic sight glass sensor to control the condenser fans according to the principles disclosed in the present invention.

Referring now to the drawing, FIG. 1 shows a refrigeration system 10 which uses condenser fan control to optimize and control the pressure in the liquid refrigerant line. Refrigeration system 10 is preferably a closed refrigerant system, and uses a hydrofluorocarbon, chlorofluorocarbon, or hydrochlorofluorocarbon refrigerant which is commonly used in the industry.

Refrigeration system 10 uses at least one compressor 12 which is a reciprocating compressor having a low pressure inlet 14 and a high pressure outlet 16. Reciprocating compressor 12 is known in the prior art, and has a constant volume output. The system refrigerant at the inlet 14 to compressor 12 is in a vaporous state at a relatively low pressure. The refrigerant at the outlet 16 of compressor 12, is in a vaporous state at a higher pressure and also at a higher temperature (after being compressed).

The high pressure vaporous refrigerant is directed into refrigerant line 18 and into a condenser 20. Condenser 20 has a cluster of fans 50 which forces air over the surface of the condenser coils, thus increasing the capacity of the condenser. In the illustrated embodiment, cluster of fans 50 comprises three fans 52, 54, and 56. The refrigerant is converted into a liquid state by the time it exits the condenser along refrigerant line 22.

The liquid refrigerant is gathered by a liquid receiver 24, and this liquid refrigerant is further directed into refrigerant line 26 which takes it to a filter/dryer unit 28.

Filter/dryer unit 28 filters particulate matter out of the refrigerant, and also removes water by use of a desiccant material. The liquid refrigerant is further directed down refrigerant line 30 and through a visual sight glass 32. Visual sight glass 32 is not necessary for controlling refrigeration system 10, however, it is found in virtually all refrigerant systems known to the prior art and can be used as a quick check of the state of the refrigerant by persons operating the system 10. The liquid refrigerant is then directed down refrigerant line 34 into the electronic sight glass sensor 36.

Electronic sight glass sensor 36 uses a thin beam of light to detect bubbles in the liquid refrigerant. Such bubbles are sometimes called "flashgas," and when such bubbles begin to form in a liquid refrigerant system, the system becomes less efficient because the thermal expansion valve's flow capacity becomes insufficient to achieve the design requirements of the system. When the refrigeration system 10 is operating in the mode wherein flashgas bubbles are existing in the refrigeration line 34, the overall system capacity is degraded and the system cannot properly cool the air spaces that it was designed to cool. An electronic sight glass sensor similar to that contemplated for sensor 36 herein is disclosed in U.S. Pat. No. 4,644,755, by Esslinger et al., such disclosure being hereby incorporated herein by reference. Electronic sight glass sensor 36 has an electrical output which can be used to help maintain the proper system characteristics, as will be discussed below.

The liquid refrigerant is preferably directed from electronic sight glass sensor 36 into a refrigerant line 38. The liquid refrigerant is then converted into a vapor by thermal expansion valve 40. Thermal expansion valve 40 creates a sudden drop in pressure in which the liquid refrigerant flashes into vapor. The vaporous refrigerant immediately enters evaporator 42 which removes enough heat to keep the refrigerant in a vaporous state. After moving through the evaporator 42, the vaporous refrigerant is directed into refrigerant line 44 where it ultimately enters the inlet 14 to compressor 12. In this way, the refrigerant has completed an entire loop of the closed refrigeration system 10.

A system controller 60 is used to electrically control the cluster of fans 50 of refrigeration system 10. The electrical output of electronic sight glass sensor 36 is communicated via sensor wiring 68 to the system controller 60. System controller 60 determines which fans (of the cluster of fans 50) should be turned on or off at any particular time based on the output of electronic sight glass sensor 36. If flashgas bubbles occur for a predetermined period of time at electronic sight glass sensor 36, then system controller 60 will command, via control wiring 64, another fan within the cluster of fans 50 to be started. If, for example, fan 1, designated by the numeral 52 is already running, then the system controller 60 will command fan 2, designated by the numeral 54, to be started. If, for example, fans 1 and 2 are already running, then system controller 60 will command fan 3, designated by the numeral 56, to be started.

If the electronic sight glass sensor 36 detects that no flashgas bubbles have existed for a second predetermined period of time, then the system controller 60 can stop one of the running fans of the cluster of fans 50. In performing this stopping of one of the fans, the system controller 60 is determining that the cooling capacity of refrigeration system 10 is presently in excess of that necessary to properly cool the air spaces associated with refrigeration system 10. It is understood that the second predetermined period of time is chosen to be at least as great as the minimum run timer of a motor driving the particular fan which had just been started.

Once the motor has been running for a time period greater than its minimum run time, then the second predetermined period of time can be shortened, if desired.

By staging fans (i.e., turning fans on and off) as necessary to properly control refrigeration system 10, system controller 60 can reduce or eliminate the prior art practice of running the condenser in a "liquid hold-up" mode. Liquid hold-up is a state where liquid refrigerant is backed up into the condenser 20 from the liquid receiver 24. Under this condition, a portion of the condenser 20 is flooded by the liquid refrigerant which is backed up into it, such that the condenser will not transfer heat as well. The overall effect of all of these occurrences is to reduce the cooling capacity of the refrigeration system 10. This prior art practice of liquid hold-up is inefficient, because electrical energy is wasted in running unnecessary fans in this situation.

An outside ambient air temperature sensor 80 can be connected to system controller 60 via sensor wiring 82. If the outside air temperature is very cool, for example during winter months, refrigeration system 10 may have too much cooling capacity even with only one fan running at the condenser 20. Under these circumstances, a liquid hold-up state can occur at condenser 20 because of excessive sub-cooling, possibly reducing the system cooling capacity to the point where the refrigerant lines 34 and 38 begin to exhibit some flashgas bubbles (at the electronic sight glass sensor 36). The liquid hold-up condition often occurs because the system cooling capacity is greatly in excess of what is required to maintain the refrigerant as a liquid at the electronic sight glass sensor 36. In this circumstance, refrigeration system 10 may be fooled because it appears that there is a leak of refrigerant somewhere in the system, and could generate an alarm. The outside air temperature sensor 80 can be used to prevent such an alarm from occurring when the outside air temperature is below a predetermined setting. This operating scheme can have an important effect, because it eliminates false alarms caused by low outside air temperature conditions.

Another preferred method of controlling a cluster of fans 50 of refrigeration system 10 is to drive one or more of the fans with a variable-speed or multi-speed motor. Fan 1, for example, could be connected to a motor having a variable-speed drive, which is throttled as necessary to properly control the cooling capacity of refrigeration system 10. In such a control scheme, fan 1 would preferably run at all times that the refrigeration system 10 is in operation. When flashgas bubbles begin to appear at the electronic sight glass sensor 36, the speed of fan 1 would be increased by the system controller 60.

If the capacity of refrigeration system 10 achieves its maximum cooling capacity with fan 1 only running, then fan 2 can be started by the system controller 60. Because fan 2 is a constant-speed fan, it always runs at its predetermined speed (i.e., at full capacity), and fan 1 can be appropriately throttled down toward its minimum speed range. As the system load increases further, the speed of fan 1 is increased again until it achieves its 100% speed rating. Under this circumstance, fan 3 is started, and fan 1 can again be throttled down to an appropriate lower speed. As a system's capacity becomes utilized to its fullest extent, then fan 1 will run again near its maximum speed. By using the signal from electronic sight glass sensor 36, fan 1's speed can be decreased at times when no flashgas bubbles are detected by electronic sight glass sensor 36 for a predetermined period of time. In this way, the overall refrigeration system 10 is run at its optimal energy usage, and substantial savings in electrical energy can be reaped in comparison with the control systems heretofore available.

An outside air temperature sensor 80 can also be used in conjunction with electronic sight glass sensor 36 to assist in controlling a cluster of fans 50 in refrigeration system 10. Where one of the fans is driven by a variable-speed or multi-speed motor, as discussed above, system controller 60 would receive signals from both electronic sight glass sensor 36 and outside air temperature sensor 80. System controller 60 would then be able to selectively turn fans on or off, and/or increase or decrease the speed of the variable-speed fan, based upon both inputs.

For example, when the outside air temperature is below a given temperature, refrigeration system 10 may still have excess cooling capacity, even when fan 1 is running by itself at its minimum speed. In this situation, a liquid hold-up could still occur at the condenser, ultimately leading to the occurrence of flashgas bubbles at electronic sight glass sensor 36, (which further may lead to a system alarm because the system conditions seem to indicate a leak in the refrigerant). To prevent an alarm from occurring in this circumstance, the alarm should be disabled if the ambient air temperature is below a predetermined value.

Figure 2:
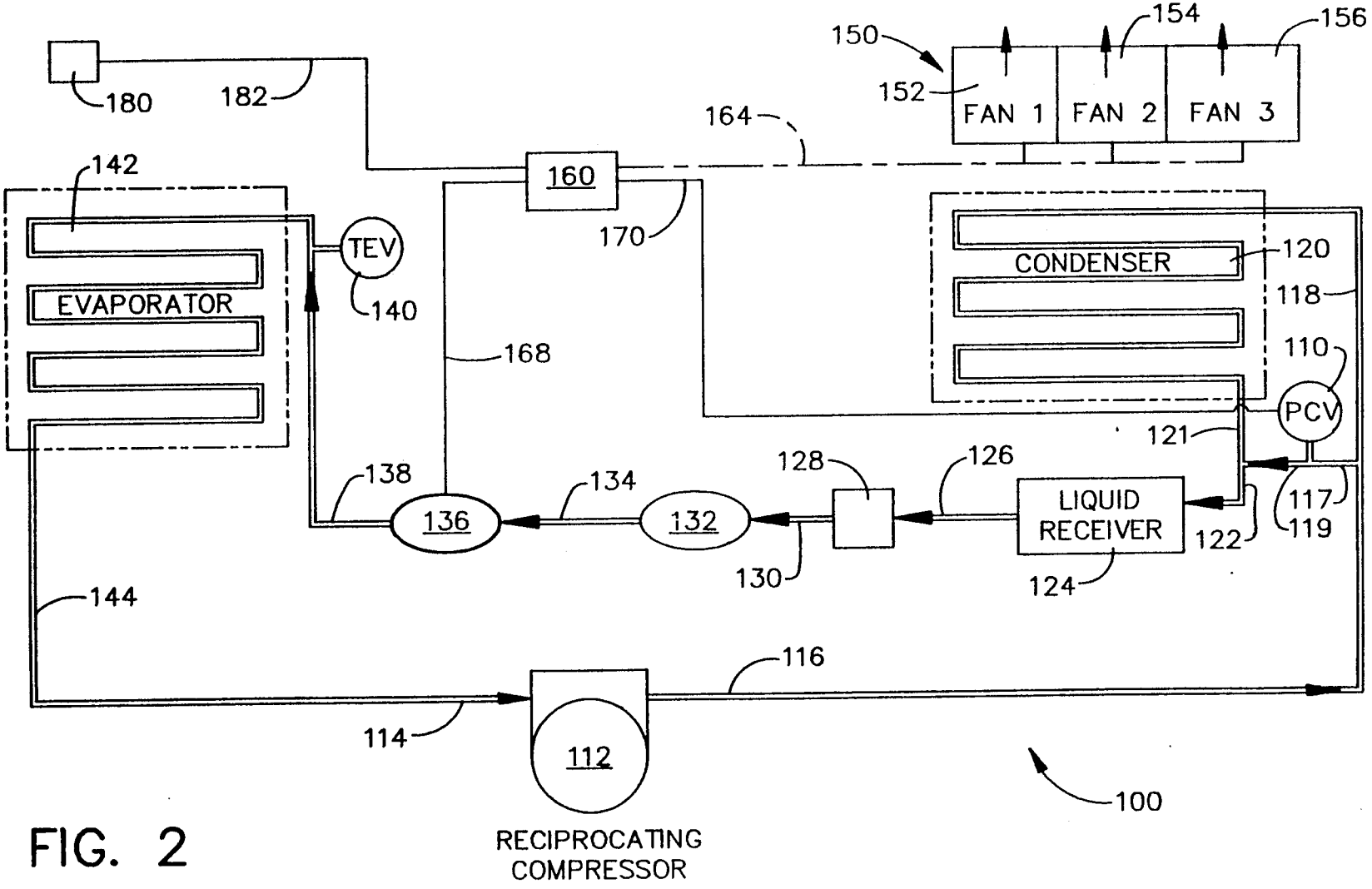
FIG. 2 is a diagrammatic view of a refrigeration system having a system controller of the present invention which receives information from an electronic sight glass sensor to control a pressure control valve located in a bypass line running between the condenser inlet and the condenser outlet according to the principles disclosed in the present invention.

FIG. 2 discloses a refrigeration system 100 which is similar to refrigeration system 10 (seen in FIG. 1) with the addition of a throttleable pressure control valve 110 in a by-pass line, depicted by the numerals 117 and 119. In refrigeration system 100, the compressor 112 directs high pressure vaporous refrigerant through its outlet 116, and along refrigerant line 118 into condenser 120. The vaporous refrigerant is condensed into liquid in condenser 120, which is thereafter directed along refrigerant lines 121 and 122 into a liquid receiver 124. A by-pass line, consisting of refrigerant lines 117 and 119, is installed between the outlet 116 of compressor 112 and the inlet to the liquid receiver 124. The function of this by-pass line will be explained below.

Liquid receiver 124 directs liquid refrigerant along a refrigerant line 126 through a filter/dryer unit 128, and then is further directed along refrigerant line 130 through a visual sight glass 132, and directed further along a refrigerant line 134. The liquid refrigerant then passes through an electronic sight glass sensor 136 which performs the same function as electronic sight glass sensor 36 of the refrigeration system 10, described above. The liquid refrigerant is further directed along refrigerant line 138 to a thermal expansion valve 140 and into evaporator 142. At this point the liquid refrigerant has been flashed into a vapor by the drop in pressure caused by thermal expansion valve 140, and this vaporous refrigerant is directed along refrigerant line 144 into the inlet 114 of compressor 112.

The system controller 160 performs similar functions to those described for the operation of system controller 60, described above. There is an electrical output of electronic sight glass sensor 136, which is connected to the system controller 160 by sensor wiring 168, and an outside air temperature sensor 180, which is connected via sensor wiring 182 to system controller 160. A cluster of fans 150 can optionally be controlled by the system controller 160 via electrical control wiring 164. In this manner, system controller 160 can operate each of the three fans, designated by the numerals 152, 154, and 156, as either constant-speed or variable-speed fans.

An additional element of refrigeration system 100 is the installation of a hot gas condenser by-pass line. In the circumstances where liquid refrigerant is excessively sub-cooled by condenser 120 (which normally occurs during low outside air temperature conditions), then a pressure control valve 110 can be used to allow a controlled amount of hot vaporous refrigerant to be mixed with the cooler liquid refrigerant coming out of condenser 120. Some of the hot vaporous refrigerant can enter the refrigerant line 117 and further pass into refrigerant line 119 as controlled by the pressure control valve 110. This hot vapor is then mixed with liquid refrigerant at the junction of refrigerant lines 121 and 119. The blended mixture then continues along refrigerant line 122 into the liquid receiver 124.

Pressure control valve 110 is controlled by the system controller 160, which, in turn, uses the signal from the electronic sight glass sensor 136 to determine if flashgas bubbles are occurring in the system. If the refrigerant is excessively sub-cooled by condenser 120 for a long enough period of time, then the pressure in liquid refrigerant line 138 will begin to drop to a lower level, which may cause flashgas bubbles to occur. In that circumstance, system controller 160 will determine that flashgas bubbles are occurring in refrigerant line 138 for a predetermined time period, and then command pressure control valve 110, via control wiring 170, to allow a certain amount of hot vaporous refrigerant to be passed from refrigerant line 117 into refrigerant line 119, thus warming the overall blended refrigerant that enters the liquid receiver 124. This will, in turn, reduce the effects of the excessive sub-cooling, and the liquid refrigerant line pressure will begin to rise again to a high enough level to reduce or eliminate the flashgas bubbles.

If, on the other hand, the liquid refrigerant becomes too warm due to an excessive amount of hot vaporous refrigerant being bypassed through refrigerant lines 117 and 119, then flashgas bubbles may begin to occur in the liquid refrigerant line 138 for that reason. If this situation exists for longer than a second predetermined period of time, then system controller 160 can command pressure control valve 110 to reduce the amount of hot vaporous refrigerant being passed from refrigerant line 117 into refrigerant line 119. This corrective action will reduce or eliminate the flashgas bubbles in the liquid refrigerant.

If the electronic sight glass sensor 136 detects that no flashgas bubbles have existed for a third predetermined period of time, then system controller 160 can command the pressure control valve 110 to reduce the amount of hot vaporous refrigerant being passed from refrigerant line 117 into refrigerant line 119. If the lack of flashgas bubbles condition occurs for a long enough time period, then the pressure control valve 110 can completely close off the bypassing of such vaporous refrigerant into refrigerant line 119.

Figure 3:
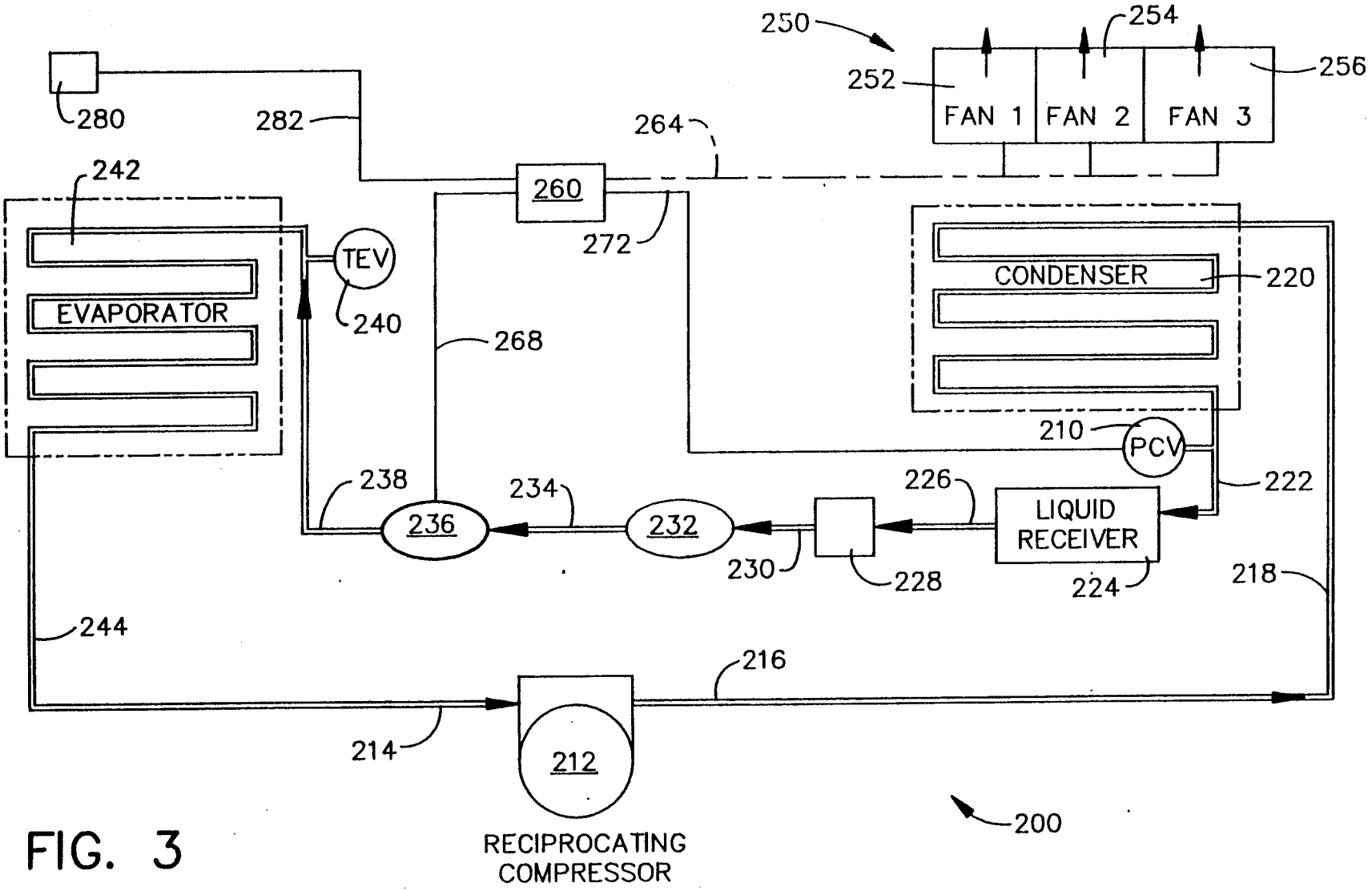
FIG. 3 is a diagrammatic view of a refrigeration system having a system controller of the present invention which receives information from an electronic sight glass sensor to control a pressure control valve located at the inlet to the liquid receiver according to the principles disclosed in the present invention.

FIG. 3 depicts a refrigeration system 200 which uses a pressure control valve to control the pressure of the liquid in the refrigeration line from the liquid receiver to the evaporator. The compressor 212 directs high-pressure vaporous refrigerant through its outlet 216 and along refrigerant line 218 into condenser 220. Condenser 220 has a cluster of fans 250 associated with it. This cluster of fans has three fans in the illustrated embodiment, designated by the numerals 252, 254 and 256 which are controlled by the system controller 260 via control wiring 264. Such control is optional, and would be implemented as described above. After the refrigerant passes through condenser 220, it becomes a liquid and is directed through refrigerant line 222 into liquid receiver 224. The liquid refrigerant is further directed along refrigerant line 226 through a filter/dryer unit 228 and along another refrigerant line 230 into a visual sight glass 232. At this point, the liquid refrigerant is further directed along refrigerant line 234 into electronic sight glass sensor 236.

Electronic sight glass sensor 236 operates in the same manner as electronic sight glass sensor 36 of the refrigeration system 10 depicted in FIG. 1. The liquid refrigerant is further directed along refrigerant line 238 into thermal expansion valve 240 at which point the refrigerant becomes a vapor. It is further directed into evaporator 242 and along refrigerant line 244 into the inlet 214 of compressor 212.

The system controller 260 receives inputs from electronic sight glass sensor 236 via sensor wiring 268, and from outside air temperature sensor 280 via sensor wiring 282. As discussed above, system controller 260 can also control the cluster of fans 250 via control wiring 264.

A throttleable pressure control valve 210 is used to control the pressure in the refrigerant line from liquid receiver 224 to the evaporator 242 at a pressure just above that at which flashgas bubbles occur at electronic sight glass sensor 236. This control is accomplished by the system controller 260 receiving an electrical signal from the electronic sight glass sensor 236 via sensor wiring 268, and then controlling the pressure control valve 210 via control wiring 272. By using these signals and control capabilities, system controller 260 can cause pressure control valve 210 to create a pressure drop in the refrigerant line 222, which continues throughout the various refrigerant lines all the way through refrigerant line 238, which directs liquid refrigerant into thermal expansion valve 240 and evaporator 242.

If flashgas bubbles occur for at least a predetermined period of time, then system controller 260 can command pressure control valve 210 to increase the pressure in refrigerant line 222. This pressure increase will be transmitted along the various refrigerant lines, through electronic sight glass sensor 236, and into thermal expansion valve 240. As the pressure increases, the flashgas bubbles will tend to disappear, thus restoring the refrigerant to a pure liquid state where it can more efficiently transfer heat.

If flashgas bubbles do not occur for at least a second predetermined period of time, then pressure control valve 210 can be commanded to somewhat decrease the pressure in refrigerant line 222.

Figure 4:
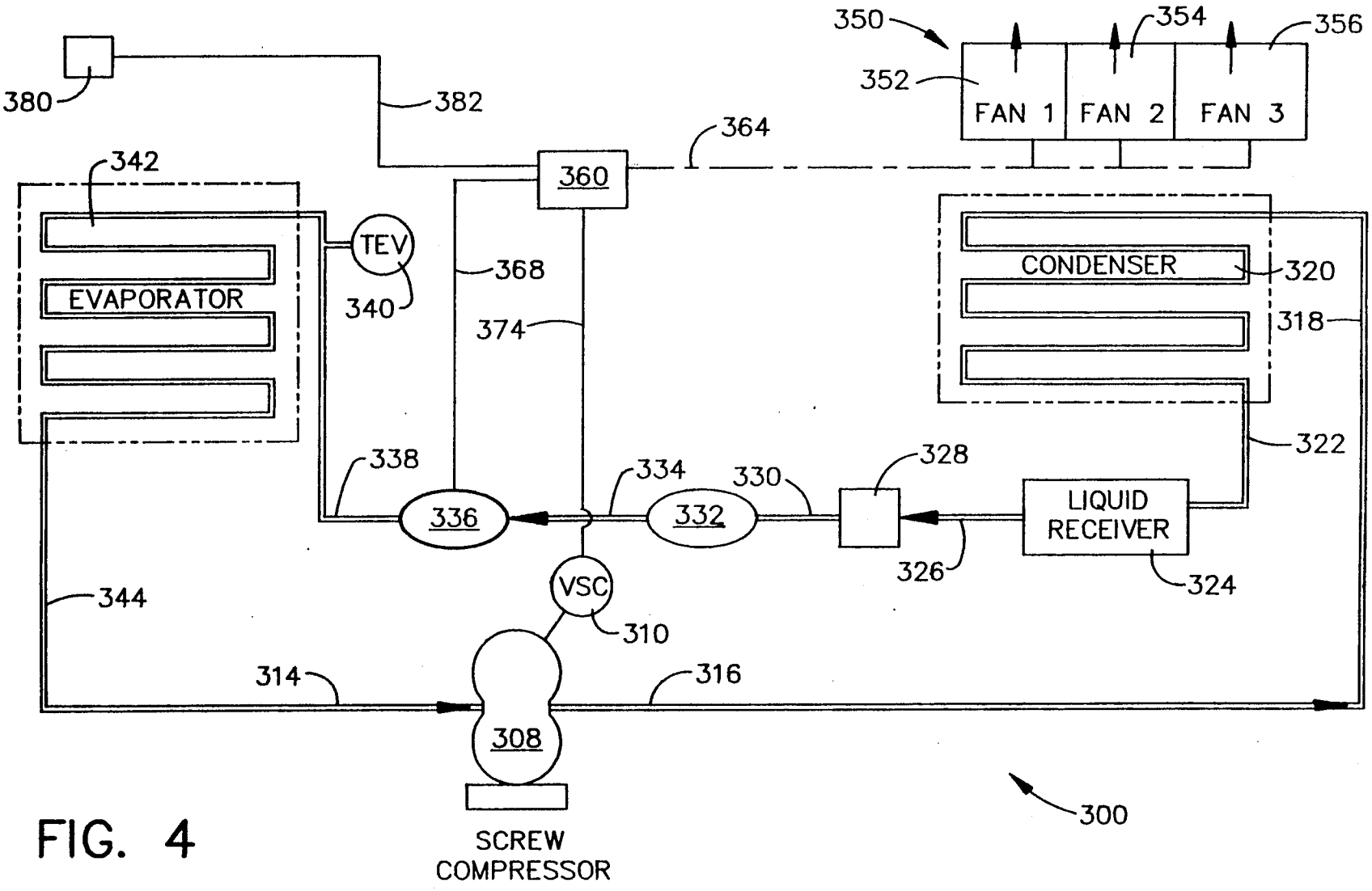
FIG. 4 is a diagrammatic view of a refrigeration system having a system controller of the present invention which receives information from an electronic sight glass sensor to control the operating speed of a screw-type compressor according to the principles disclosed in the present invention.

FIG. 4 depicts a refrigeration system 300 which uses a screw compressor that can be driven by a variable-speed drive to lower or raise the overall system pressure of the refrigerant. Screw compressor 308 directs refrigerant through its outlet 316 and into a refrigerant line 318 to a condenser 320. Condenser 320 has an associated cluster of fans 350 which are optionally controlled by system controller 360 via control wiring 364. The three fans, designated by the numerals 352, 354, and 356, can all be constant-speed fans, or one of them can be a variable-speed fan, as described above. The high-pressure vaporous refrigerant is turned into a liquid by condenser 320 and is directed along refrigerant line 322 into a liquid receiver 324.

Liquid refrigerant is further directed through refrigerant line 326, through a filter/dryer unit 328, and through another refrigerant line 330 into a visual sight glass 332. The liquid refrigerant is further directed along refrigerant line 334 and through an electronic sight glass sensor 336, which operates in the same manner as electronic sight glass sensor 36 of refrigeration system 10 described above. The liquid refrigerant is further directed through refrigerant line 338 where the liquid refrigerant is converted into a vapor by thermal expansion valve 340 and evaporator 342. The vaporous refrigerant is then directed along the refrigerant line 344 into the inlet 314 of the screw compressor 308. System controller 360 has electrical inputs from an outside air temperature sensor 380 which provides the information via sensor wiring 382, and from the electrical output of electronic sight glass 336, via sensor wiring 368.

System controller 360 can command a variable speed controller 310 to either increase or decrease the speed of the screw compressor 308, via control wiring 374. In the refrigeration system 300, the liquid pressure of the refrigerant at the electronic sight glass sensor 336 can be directly controlled by the screw compressor's speed. As flashgas bubbles begin to appear at electronic sight glass sensor 336, the system controller 360 can immediately command screw compressor 308 to start to increase its speed, thus increasing the system pressure. As the system pressure increases, the flashgas bubbles at electronic sight glass sensor 336 will tend to disappear, thus keeping the refrigeration system 300 running at an optimum condition.

If no flashgas bubbles are detected by electronic sight glass sensor 336 for a predetermined period of time, then the system controller 360 can command the screw compressor 308 to start to slow down, thus reducing the overall system pressure. This reduction of system pressure can continue until the electronic sight glass sensor 336 begins to sense flashgas bubbles once again. At this point, the screw compressor 308 can be commanded to slightly increase its speed, thus tending to eliminate the flashgas bubbles at electronic sight glass sensor 336.

In the refrigeration system 300, the electrical power utilized in the system is directly proportional to the system flow and pressure created by screw compressor 308. By controlling the operation of screw compressor 308 so that it runs at its minimum speed required to keep flashgas bubbles from appearing at electronic sight glass 336, the electrical power consumed by refrigeration system 300 is kept to a minimum. This minimum operating condition is the optimal energy usage in a refrigeration system, and is a great improvement over refrigeration systems of the prior art.

Figure 5:
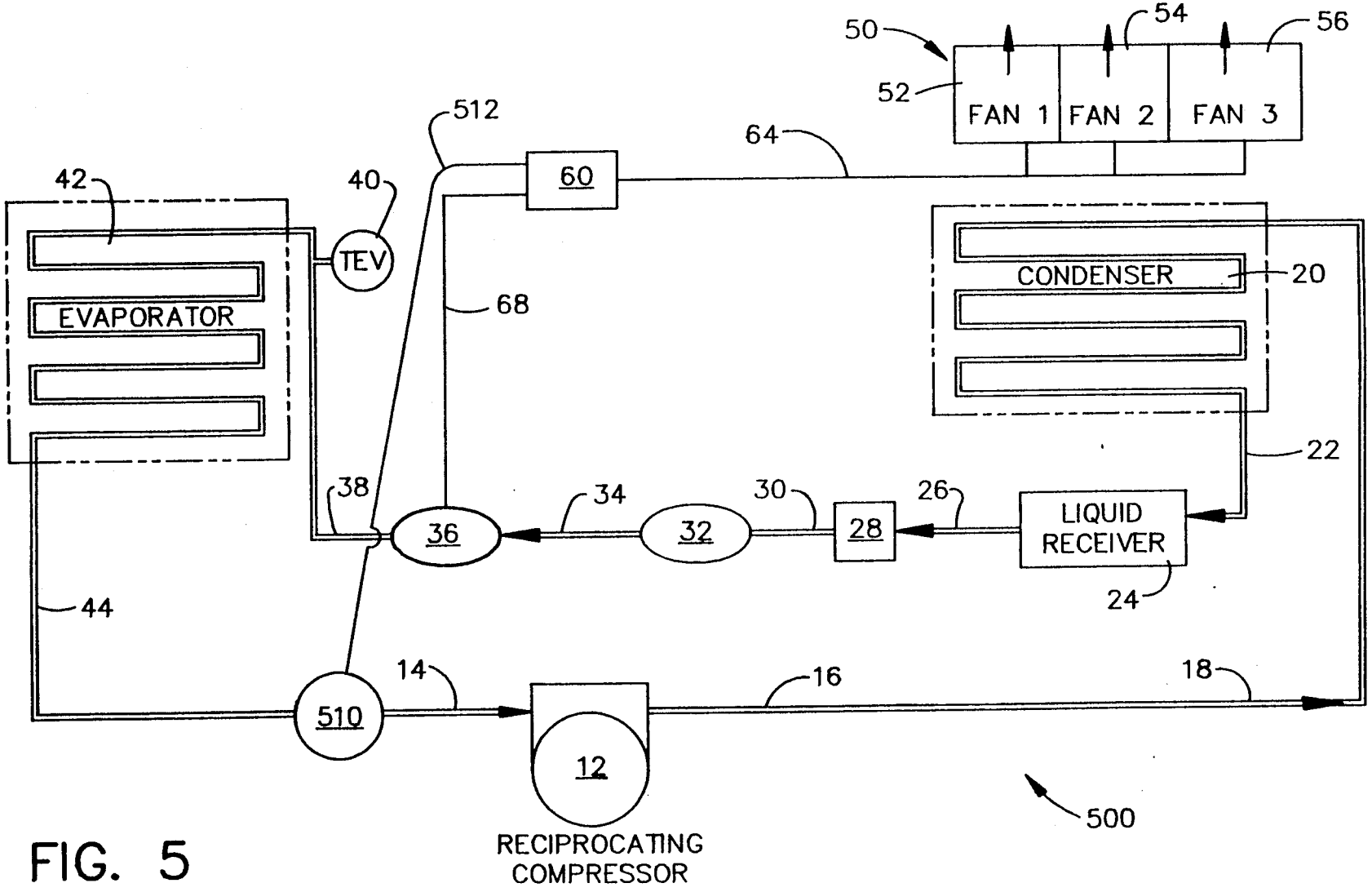
FIG. 5 is a diagrammatic view of a refrigeration system having a system controller of the present invention which receives information from an electronic sight glass sensor, and which can generate an alarm so that corrective action is taken or the refrigeration system is shut down before the compressor is damaged.

FIG. 5 depicts a further embodiment of a refrigeration system 500 which has a special sensor to protect the compressor. The refrigeration system 500 of FIG. 5 is identical to refrigeration system 10 of FIG. 1, with the exception of the addition of a second electronic sight glass sensor 510. Electronic sight glass sensor 510 is part of a back-up protection system to prevent liquid droplets of refrigerant from entering the compressor 12, which could damage that compressor, if allowed to continue to run in that circumstance.

Electronic sight glass sensor 510 can detect flashgas bubbles in a liquid refrigerant line. By the same token, electronic sight glass sensor 510 can detect liquid droplets in a vaporous refrigerant line. When such liquid droplets are detected, an alarm can be sounded or the compressor 12 can be commanded to immediately shut down before it becomes damaged. The optimal location for such an electronic sight glass sensor 510 would be in the refrigerant line 44, between evaporator 42 and the inlet 14 of compressor 12, preferably near inlet 14. The electrical output of electronic sight glass sensor 510 can be communicated via sensor wiring 512 to the system controller 60, which can command an alarm to be sounded and/or the compressor 12 to be turned off. It is understood that electronic sight glass sensor 510 could easily be retrofitted into virtually every refrigeration system that exists today.

A major advantage of the present invention is that it can be retrofitted into a great number of existing refrigeration systems. For example, in the "fan control" system depicted in FIG. 1, only the system controller 60 and the electronic sight glass sensor 36 need to be added to convert an existing refrigeration system into a system that operates according to the principles of the present invention. An existing relatively crude fan "on-off" system can be, thus, transformed into a system which can save electrical energy. If one of the fans is retrofitted with a variable-speed or multi-speed drive, then the existing system can be transformed into an energy saving system which runs at near-optimal energy usage conditions.

Other types of refrigeration systems that exist in the prior art include screw compressor systems, similar to that depicted in FIG. 4. Such existing systems can also be upgraded into energy saving systems by adding a system controller 360 and an electronic sight glass sensor 336, and controlling the compressor(s) in accordance with the principles of the present invention.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. A method of controlling the operation of a refrigeration system of the type that includes a compressor, a condenser, a liquid receiver, an evaporator, at least one fan, a proportional pressure control valve and at least one refrigerant line, said method comprising the steps of:

(a) monitoring the presence of flashgas bubbles in a liquid refrigerant of the refrigeration system and creating a first electrical signal upon the sensing of flashgas bubbles in said refrigerant line;

(b) communicating said first electrical signal to a system controller, said system controller creating a second electrical signal, wherein said second electrical signal is an analog signal; and (c) selectively controlling the operation of said proportional pressure control valve, which is located in a hot gas bypass line between the condenser inlet and the condenser outlet, to introduce hot bypass refrigerant gas into the liquid refrigerant in the line between the liquid receiver and the evaporator, in response to said second electrical signal, thereby warming the liquid refrigerant so as to reduce or eliminate said flashgas bubbles in the liquid refrigerant, while simultaneously limiting energy consumption to an optimal or near-optimal rate.

2. A method of controlling the operation of a refrigeration system as recited in claim 1, wherein an electronic sight glass sensor is used for monitoring the presence of flashgas bubbles in a liquid refrigerant of the refrigeration system, said electronic sight glass creating said first electrical signal in response to the existence of flashgas bubbles in said liquid refrigerant.

3. A method for optimizing the efficiency of a refrigeration system having a plurality of physical components including a compressor, a condenser, a liquid receiver, an evaporator, a condenser fan, a proportional pressure control valve, and refrigeration lines connecting various system components, said method comprising the steps of:

(a) providing a device for monitoring the relative abundance of flashgas bubbles in liquid refrigerant within said refrigeration system;

(b) creating a first electrical signal indicating the relative abundance of flashgas monitored;

(c) communicating said first electrical signal to a refrigeration system controller, said system controller creating a second electrical signal, wherein said second electrical signal is an analog signal; and (d) selectively controlling the operation of said proportional pressure control valve in response to said second electrical signal, whereby said system controller automatically maintains the relative abundance of flashgas at a predetermined level by introducing hot bypass refrigerant gas into the liquid refrigerant in the line between the liquid receiver and the evaporator, thereby warming the liquid refrigerant so as to reduce said flashgas bubbles in teh liquid refrigerant, while utilizing minimum amounts of energy to operate said refrigeration system.

4. A method for optimizing the efficiency of a refrigeration system as recited in claim 3, wherein said device provided for monitoring said flashgas bubbles comprises an electronic sight glass sensor arranged along a refrigeration line between the condenser and the evaporator of said refrigeration system to monitor the relative abundance of flashgas bubbles in the refrigerant line entering the evaporator.

5. A control system for optimizing the efficiency of a refrigeration system having a plurality of physical components including a compressor, a condenser, at least one fan, an evaporator, a proportional pressure control valve, and refrigerant lines connecting various of the components, said control system comprising:

(a) means for automatically monitoring the relative abundance of flashgas in liquid refrigerant within said refrigeration system;

(b) means for creating a first electrical signal corresponding to the relative abundance of flashgas monitored in said refrigeration system; and (c) a system controller which receives said first electrical signal, said system controller creating a second electrical signal, wherein said second electrical signal is an analog signal, and wherein said system controller controls the operation of said proportional pressure control valve, in response to said second electrical signal to maintain the relative abundance of flashgas at a predetermined level by introducing hot bypass refrigerant gas into the liquid refrigerant in the line between the liquid receiver and the evaporator, thereby warming the liquid refrigerant, so as to reduce said flashgas bubbles in the liquid refrigerant, while optimizing the energy usage of said physical components.

6. A control system for optimizing the efficiency of a refrigeration system as recited in claim 5, wherein said means for monitoring the relative abundance of flashgas comprises an electronic sight glass arrangement located along a refrigerant line between said condenser and said evaporator.

7. A control system for optimizing the efficiency of a refrigeration system as recited in claim 5, further comprising means for sensing the relative presence of liquid droplets in a refrigerant line, said sensing means located along a refrigerant line which provides vaporized refrigerant to said compressor, and means for generating an electrical signal indicative of the relative presence of liquid droplets sensed.

* * * * *